United States Patent [19]

Jessamine

[11] 4,429,839

[45] Feb. 7, 1984

[54] WATER SKI TOW ROPE REEL APPARATUS

[76] Inventor: Donald W. Jessamine, 401 Aurora St., Phillipsburg, N.J. 08865

[21] Appl. No.: 329,233

[22] Filed: Dec. 10, 1981

[51] Int. Cl.[3] ..... B65H 75/28; B65H 75/40

[52] U.S. Cl. ..... 246/96; 114/254; 242/86.5 A; 242/100

[58] Field of Search ..... 114/254; 242/96, 86.5 A, 242/77, 100, 100.1, 100.2, 197, 84.8; 242/86, 86.1, 86.2, 86.3, 86.4

[56] References Cited

U.S. PATENT DOCUMENTS

| | | | |
|---|---|---|---|
| 2,856,470 | 10/1958 | Hyde | 242/77 X |
| 2,998,796 | 9/1961 | Wittrock | 242/86.5 A |
| 3,006,309 | 10/1961 | Rowley | 242/86.5 A |
| 3,021,088 | 2/1962 | Bennett | 242/86.5 A |
| 3,041,996 | 7/1962 | Roberts | 242/86.5 A |
| 3,113,547 | 12/1963 | Stewart | 242/85.1 X |
| 3,162,395 | 12/1964 | Bray | 242/86.5 A |
| 3,232,555 | 2/1966 | Gorrell et al. | 242/86.5 A |
| 3,423,044 | 1/1969 | Beiderwell | 242/96 |
| 3,481,557 | 12/1969 | Miller | 242/96 |
| 3,494,570 | 2/1970 | Jones, Jr. | 242/86.5 A |
| 3,498,563 | 3/1970 | Palmieri | 114/254 X |
| 3,638,876 | 2/1972 | Bullock | 242/86.5 A X |
| 3,908,277 | 9/1975 | Rutty | 242/84.8 X |
| 4,244,536 | 1/1981 | Harrill | 242/96 |
| 4,282,954 | 8/1981 | Hill | 242/96 X |
| 4,306,688 | 12/1981 | Hechler | 242/96 X |

*Primary Examiner*—Stuart S. Levy
*Assistant Examiner*—Scott J. Haugland
*Attorney, Agent, or Firm*—H. Gordon Shields

[57] ABSTRACT

Water ski tow rope apparatus includes a reel rotatably secured to a housing and the reel and housing have a slot through which water ski tow rope extends through the housing to be wound about the reel within the housing. The water ski tow rope is completely removed from the apparatus for use and for storage is completely disposed in the apparatus. The apparatus includes a well and tabs for holding both ends of the water ski tow rope.

5 Claims, 3 Drawing Figures

WATER SKI TOW ROPE REEL APPARATUS

BACKGROUND OF THE INVENTION

1. Field of the Invention

This invention relates to water ski tow ropes, and, more particularly, to a water ski tow rope housing for storing a tow rope when not in use.

2. Description of the Prior Art

Water ski tow ropes in contemporary use are usually simply coiled for storage within the boat when not in use. The coiled rope presents a problem in the boat for several reasons, such as getting in the way of the occupants of the boat if the rope is not stored in a locker, getting fouled whether stored in a locker or not, which makes it rather difficult to unwind or uncoil properly without tangles in the rope. Moreover, there are inherent difficulties, generally speaking, in both coiling and uncoiling the rope.

To overcome some of the problems associated with water ski tow ropes, such as those enumerated in the preceding paragraph, several different types of reels have been proposed. However, the reels of the prior art are secured to the tow boat and accordingly present other problems. One of the problems associated with the reel secured to a boat is the evening out of the strain on the rope, or the symmetrical loading of the rope, for towing purposes. This problem, in turn, has been considered, and several suggestions have been proposed. Examples of some of the reel type apparatus, and the solution to the symmetrical loading of a tow rope, are illustrated in various U.S. Patents. Among the U.S. patents which have considered the problems is U.S. Pat. No. 2,998,796. The '796 patent discloses a fixed reel secured to a boat. The tow rope is wound about the reel when the tow rope is not in use. The tow rope actually is in two sections secured together by a snap swivel hook for ease in securing the tow rope to the wheel. That is, the tow rope consists of two independent ropes, one a relatively short length of rope, and one a relatively long length of rope. When the long length of rope is unwound from the reel, it is secured to the short rope to comprise a single tow rope.

Another exemplary patent is U.S. Pat. No. 3,006,309. The '309 patent discloses a reel secured to the stern section of a boat. The reel pivots into and out of use in storage positions, as desired. The reel acts as a frame or harness between the tow rope and the boat when the tow rope is in its use position.

U.S. Pat. No. 3,021,088 discloses a tow rope reel which includes a guide for winding the tow rope about the reel for storage purposes. The reel is secured to the boat, but part of the reel pivots to allow the tow rope to be secured to the boat through a bridle arrangement for towing purposes. The bridle arrangement is one solution to the problem of utilizing a reel for a tow rope and yet having a symmetrical pull on the tow rope to the boat for towing a water skier.

U.S. Pat. No. 3,041,996 discloses a tow rope system using a reel secured to the boat and another type of harness or bridle system for transferring the actual pulling force on the rope to the boat. The '996 patent provides one illustration, and the '088 patent provides another illustration of attempts to solve the symmetrical load or force problem discussed above, as well as the reel and storage problem for a tow rope.

U.S. Pat. No. 3,113,547 discloses a fixed reel system secured to a boat which utilizes an arm through which the tow rope extends between the boat and the reel. The tow rope is secured directly to the boat, and it extends through an arm secured to the reel. The arm is in direct line with the point of securement of the tow rope to the boat when the tow rope is in use. When it is desired to wind the tow rope about the reel, the arm is used as a guide to feed the rope onto the reel.

U.S. Pat. No. 3,232,555 discloses a type of reel using a motor for powering the reel. The reel is secured to the boat and the tow rope extends from the reel through the transom of the boat to its use position. The rope includes a knot which limits the movement of the rope out of the boat, and accordingly no direct strain is placed on the reel when the tow rope is in use.

U.S. Pat. No. 3,494,570 discloses another type of water ski tow rope apparatus utilizing a reel secured to the boat and a connection at the boat and on the rope for transferring the towing force from the rope to the boat.

U.S. Pat. No. 3,498,563 discloses another type of reel system utilizing an arm in a manner somewhat similar to the arm employed in the '547 patent discussed above. The reel in the '563 patent is secured to the stern of a boat, and a harness or bridle system is secured to the tow rope for transferring forces in a symmetrical manner to the boat and away from the reel.

A winding reel for a water ski tow rope, with the reel again secured to the boat, is disclosed in U.S. Pat. No. 3,638,876. Part of the reel is rotatable in the '876 patent, and is spring biased to a center position.

It will be noted that the reel apparatus of each of the above discussed patents are secured to a boat, and are accordingly in a fixed position. While some of the reels may pivot, or otherwise move, nevertheless they are secured substantially permanently to a boat. The apparatus of the present invention is not fixed to a boat. The apparatus is portable in that it may be disposed at any convenient location in the boat for storage purposes. Moreover, the reel is not secured to the boat, but is "free" and is disposed out of the boat while the tow rope is in use. When the tension strain is taken off of the tow rope, both the rope and the reel apparatus fall to the surface of the water and remain there. The reel apparatus is floatable and accordingly will not sink. By using the reel apparatus of the present invention, the rope may be secured directly to the boat without requiring any additional apparatus, such as a bridle or harness adaptation, or a collar on the rope, or a knot on the rope, as illustrated in some of the patents discussed above.

SUMMARY OF THE INVENTION

The invention described and claimed herein comprises a housing for water ski tow rope storage and a reel within the housing on which the tow rope is wound for storage purposes. The tow rope is removable from the housing during use of the tow rope, and the housing may be conveniently stored in the boat. The housing is floatable both with the tow rope disposed therein and with the tow rope separated from the housing and reel.

Among the objects of the present invention are the following:

To provide new and useful water ski tow rope apparatus;

To provide new and useful apparatus for storing water ski rope;

To provide new and useful reel apparatus for storing a tow rope;

To provide new and useful apparatus for winding a tow rope for storage purposes;

To provide new and useful reel apparatus for a tow rope having a housing through which the tow rope extends and which housing is disposed about the reel; and To provide new and useful water ski tow rope apparatus including a housing through which the tow rope extends and a reel within the housing on which the tow rope is wound for storage purposes and from which the tow rope is unwound and removed for use purposes.

DESCRIPTION OF THE PREFERRED EMBODIMENT

Figure 1:
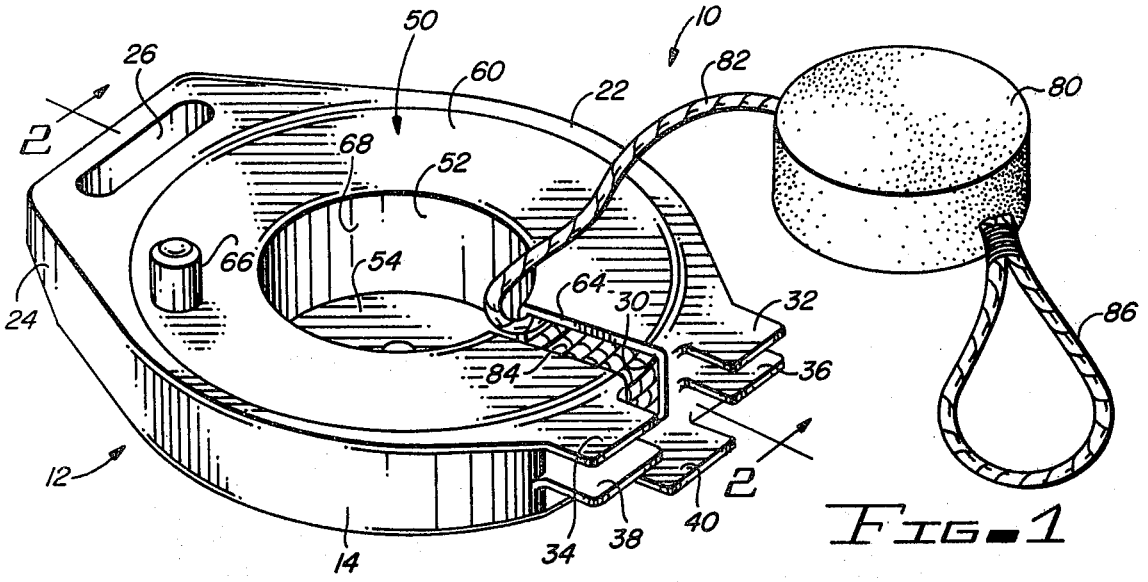
FIG. 1 is a perspective view of the apparatus of the present invention.
Figure 2:
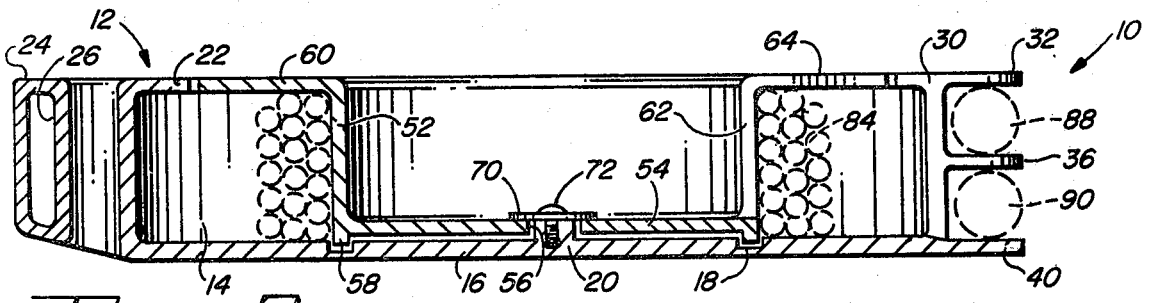
FIG. 2 is a view in partial section of the apparatus of FIG. 1, taken generally along line 2—2 of FIG. 1.
Figure 3:
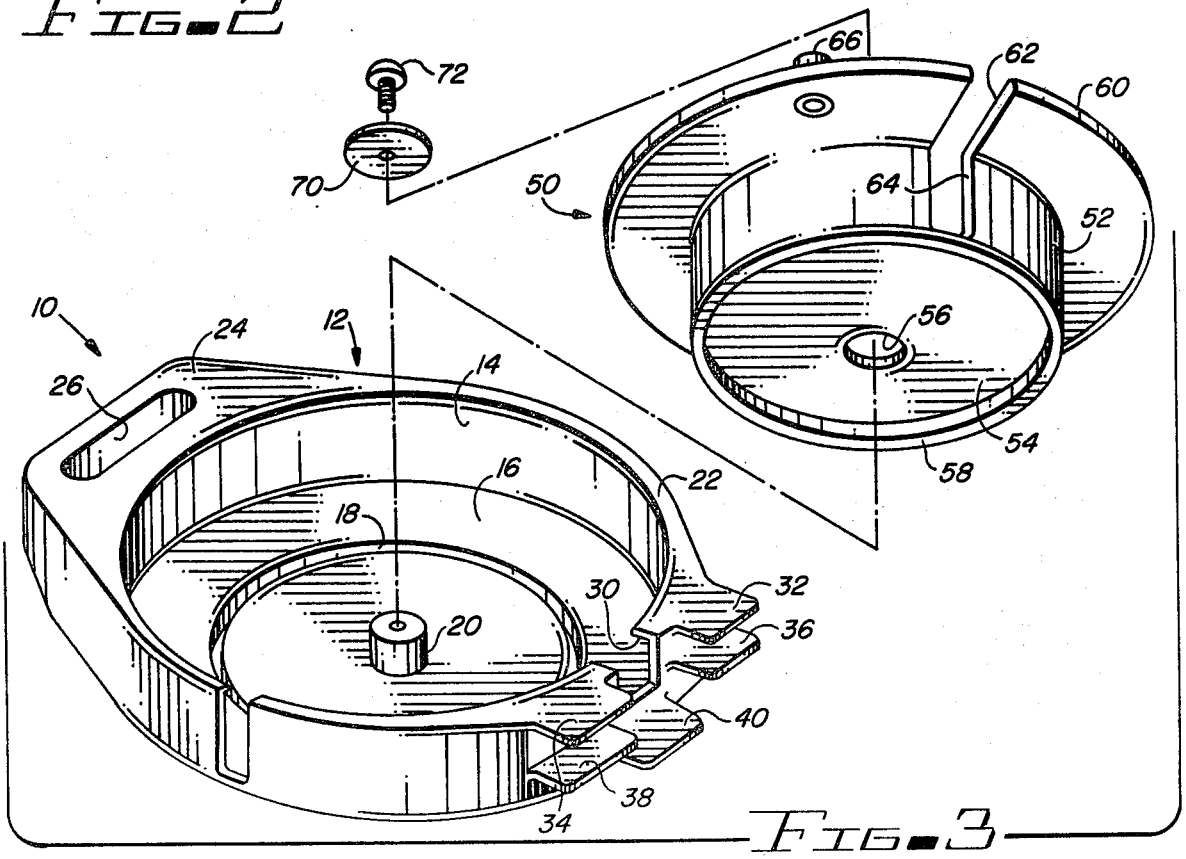
FIG. 3 is an exploded perspective view of the apparatus of the present invention.

FIG. 1 is a perspective view of water ski tow rope reel apparatus 10 embodying the present invention. A float 80 is shown secured to a tow rope 82, with the rope 82 disposed within and secured to the apparatus 10. FIG. 2 is a view in partial section of the water ski tow rope apparatus 10 taken generally along line 2—2 of FIG. 1, with a plurality of coils 84 of the water ski tow rope 82 disposed within the apparatus 10, with the coils 84 shown in phantom. The reel apparatus 10 includes two primary or major portions, a housing 12 and a reel 50. FIG. 3 is an exploded perspective view of the reel apparatus 10, showing the reel 50 separated from the housing 12. For the following discussion of the reel apparatus 10, reference will be made to FIGS. 1, 2, and 3.

The housing 12 includes a partially circular shell or wall 14 extending upwardly from a bottom 16. The bottom 16 includes a groove 18 which extends downwardly into the bottom 16, and which is generally concentric with a boss 20 which extends upwardly from the bottom 16. The boss includes a tapped aperture which receives a screw 72. The groove 18 is circular. It cooperates with the reel 50 as will be discussed in detail below.

The generally circular shell or wall 14 also includes an inwardly extending rim 22. The rim 22 extends radially inwardly from the upper portion of the wall 14, substantially parallel to the bottom 16.

Secured to the housing 12 at one end is a handle portion 24. The handle portion 24 includes a slot 26 which receives the fingers of a user. The handle portion 24 is a continuation of the circular shell or wall 14. The handle portion comprises a non-circular portion of the housing extending outwardly and defining one end of the housing 12. The purpose of the integral handle 24 is for convenience in carrying the reel apparatus 10.

As best shown in FIGS. 1 and 3, the inwardly extending rim 22 defines a circular opening in the housing 12, in which the reel 50 is disposed.

At the opposite end of the housing 12, remote from the handle portion 24, there are a plurality of tabs which extend outwardly from the housing. Included are a pair of upper tabs 32 and 34, a pair of middle tabs 36 and 38, and a lower tab 40. The upper tabs 32 and 34 define an outwardly extending continuation of the rim 22. The tabs 32 and 34 are spaced apart radially from each other. The middle tabs 36 and 38 extend outwardly from the wall 14 and are generally parallel to the upper tabs 32 and 34, respectively. The tabs 36 and 38 are referred to as "middle" tabs, because they extend outwardly about middle way between the bottom 16 of the housing and the rim 22.

The lower tab 40 is generally a continuation of the bottom 16. It is a single tab, located between, vertically, the upper and middle tab pairs 32, 36 and 34, 38.

Aligned with the lower tab 40, and disposed centrally between the upper and middle tab pairs 32, 36 and 34, 38, is a slot 30. The slot 30 extends through the rim 22 and downwardly from the rim 22 along the vertical dimension of the wall 14. The slot 30 receives the rope 82 for winding the rope 82 in coil 84 within the housing 12 and about the reel 50.

The reel 50 includes a generally circular wall 52 which extends upwardly from a bottom 54 and substantially perpendicular thereto. Centrally disposed in the bottom 54 is an aperture 56. The diameter of the aperture 56 is slightly greater than the outer diameter of the boss 20 which extends upwardly from the bottom 16 in the housing 12. The boss 20 extends through the aperture 56 when the reel 50 is disposed within the housing 12, as shown in FIG. 2.

A circular ridge 58 extends downwardly from the bottom 54. The ridge 58 extends into the groove 18 of the bottom 16 in the housing 12. The cooperation between the ridge 58 and the groove 18, together with the aperture 56 and the boss 20, allows the reel 50 to maintain its orientation in the housing 12 and allows the reel 50 to be rotated with respect to the housing 12 for winding and unwinding the rope 80.

A radially outwardly extending flange 60 is secured to the top of the wall 52 of the reel 50. The flange 60 extends outwardly toward the inner periphery of the rim 22. There is a slight space between the outer edge of the flange 60 and the inner periphery of the rim 22, as best shown in FIG. 2. The space between the rim 22 and the flange 60 is substantially less than the diameter of the rope 82. The narrow space prevents the rope from leaving or from being removed from the reel 50 except through the slot 30. At the same time, the slot prevents binding between the reel and the housing and allows water to be freely drained.

The reel 50 includes a pair of aligned slots, a slot 62 which extends vertically through the wall 52, and a slot 64 which extends horizontally from the slot 62 through the flange 60. The slots 62 and 64 are aligned, and are a continuation of each other. The terms "vertically" and "horizontally" are used to refer to the alignment and orientation of the slots 62 and 64 as shown in FIG. 2. Thus, the slot 62 is an axially, vertically extending slot on the wall 52, and the slot 64 is a radially extending horizontal slot in the flange 60. The slot 62 extends upwardly from the bottom 54, and the slot 64 extends outwardly from the wall 52, and/or from the slot 62, to the outer periphery or the outer edge of the flange 60.

A handle 66 is secured to the flange 60 adjacent to the outer edge of the flange 60, and preferably spaced apart from the slot 64. The purpose of the handle 66 is to rotate the reel 50 relative to the housing 12 for winding the rope 82 into the housing 12 on the reel 50.

A well 68 is defined within the reel 50, upwardly from the bottom 54 and inside the circular, cylindrical wall 52. This well comprises a receptacle for the float 80. As is typical with water ski tow ropes, the float 80 is disposed adjacent to a loop 86. The purpose of the loop 86 is to fasten the tow rope 82 to a boat for pulling a skier.

The opposite end of the tow rope 82 from the loop 86 includes a pair of handles 88 and 90, shown in phantom in FIG. 2. The handles 88 and 90 are grasped by a user of the apparatus, a water skier, for ski purposes. The securing of the handles 86 and 88 to a tow rope are well known and understood, and are not included in the drawing.

For using the water ski tow rope apparatus 10, the slots 62 and 64 are aligned with the slot 30 in the housing 12. The float 80 and the loop 86 are placed in the well 68 of the reel 50, on the bottom 54 of the reel and within the cylindrical wall 52 of the reel. The rope 82 extends through the aligned slots 62 and 30, outwardly from the reel apparatus 10. With the loop 86 and the float 80 disposed within the well 68 of the reel 50, and with the tow rope 82 then extending through the aligned slots, the user of the apparatus grasps the handle 66 with one hand, and the handle 26 of the housing with the other hand, and rotates the reel 50 relative to the housing 12.

The rotation of the slot 62 away from alignment with the slot 30 causes the rope 82 to be wound about the outside of the reel cylinder 52 and within the housing 12, as shown in FIG. 2. This rotation of the reel 50 by means of the handle 66 and the winding of the rope coils 84 continues until the entire length of the tow rope 80 is disposed within the reel apparatus 10.

Finally, the handles 86 and 88 at the outer end of the tow rope 82, remote from the float 80 and the loop 86, are disposed within the tabs, or between the tabs, as shown in FIG. 2. For double handles, such as the handles 86 and 88 illustrated in FIG. 2, one handle 86 of the two handles is placed between the upper tabs 32, 34 and the middle tabs 36, 38, while the second handle 88 is placed between the middle tabs 36, 38 and the lower tab 40. The vertical spacing between the upper pair of tabs and the middle pair of tabs, and between the middle pair of tabs and the lower tab is slightly less than the diameter of the handles, and the tabs accordingly exert a slight inward bias on the handles to hold them securely in place.

For water ski ropes which include only a single handle, rather than a double handle (pair of handles), the single, long handle will be placed between the upper tabs 32, 34 and the middle pair of tabs 36, 38 in most cases. It may also be placed between the lower tab 40 and the middle pair of tabs 36, 38. The placing of a single handle is, of course, a matter of choice and convenience.

The space within the housing 12 and outside of the reel cylindrical wall 52, and below the flange 60 of the reel provides sufficient space for storing the longest practical tow rope in contemporary usage. At the same time, the tow rope apparatus 10 is relatively compact and lightweight. It is preferably made of a plastic, or polymer, material which is lightweight and accordingly is floatable, and yet is strong enough to withstand the normal handling, stowing, and related problems to which such apparatus is usually subjected in the course of ordinary usage. Obviously, the reel apparatus 10 is impervious to water, both fresh water and salt water, and to the corrosion attendant therewith, particularly salt water. If desired, holes may extend through the bottom 16 of the housing 12 and also through the bottom 54 of the reel 50 for drainage purposes. Such drain holes are not shown in the drawing.

For unwinding the coils 84 of the rope 82 from the reel apparatus 10, the user reverses the process described above. That is, the handles 86 and 88 are first removed from the holding tabs 32, 34 and 36, 38 and 40. A pull on the handles 86 and 88, while holding the apparatus 10 stationary by the handle 26 of the housing 12, will cause the reel 50 to rotate as the rope is pulled through the slot 30 of the housing 12. Rotation of the reel 50 then continues as long as there is a pull on the rope 82. When the entire rope has been unwound from the space between the housing and the reel, which comprises the coils 84 of the rope 82 wound about the reel cylinder wall 52 shown in FIG. 2, the slot 62 and its continuation slot 64 will automatically be aligned with the slot 30. The float 80 and the loop 86 may then be removed from the well 68 of the reel 50. The entire tow rope 80 is then available for use, and the reel apparatus 10 may be stored or stowed within the tow boat, as desired.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Water ski tow rope reel apparatus comprising, in combination:

housing means, including
- a floor,
- a wall secured to the floor and extending substantially perpendicular thereto,
- a handle for holding the housing, and
- a slot extending through the wall through which a tow rope passes;

reel means secured to the housing means and rotatable relative thereto, including
- a bottom wall disposed adjacent to the bottom of the housing means,
- cylindrical wall means extending substantially perpendicular to the bottom wall means and about which the tow rope is wound,
- an outwardly extending flange remote from the bottom wall and extending outwardly radially from the cylindrical wall, and
- a slot extending through the flange and the wall through which a portion of the tow rope is disposed;

handle means secured to the reel means for rotating the reel means relative to the housing means for winding the rope through the slot in the housing means and about the cylindrical wall of the reel means; and holding means integral with said housing and disposed adjacent to the slot for securing a handle of a water ski tow rope to the housing means, including a plurality of flat, opposed tabs spaced apart from each other and parallel to the floor of the housing and extending downwardly from the housing means.

2. The apparatus of claim 1 in which the handle means is secured to the reel means remote from the slot.

3. The apparatus of claim 1 in which the housing means includes a boss extending upwardly from the floor and the reel means includes an aperture in the bottom through which the boss extends.

4. The apparatus of claim 3 in which the housing means further includes a groove in the floor disposed concentrically about the boss.

5. The apparatus of claim 4 in which the reel means includes a downwardly extending ridge which extends to the groove in the floor of the housing for guiding the reel means as it rotates relative to the housing means.

* * * * *